United States Patent [19]

Close

[11] Patent Number: 4,502,717

[45] Date of Patent: Mar. 5, 1985

[54] PNEUMATICALLY RELEASABLE, TAMPER-RESISTANT SECURITY TAG

[75] Inventor: Leo R. Close, Sepulveda, Calif.

[73] Assignee: Mrs. Lawrence Israel, Van Nuys, Calif.

[21] Appl. No.: 501,881

[22] Filed: Jun. 7, 1983

[51] Int. Cl.[3] ..... B65D 33/34

[52] U.S. Cl. ..... 292/316

[58] Field of Search ..... 24/603, 108, 110, 150; 70/34, 401, DIG. 48; 292/316

[56] References Cited

U.S. PATENT DOCUMENTS 3,973,418 8/1976 Close ..... 70/DIG. 48 X 4,372,738 2/1983 Black et al. ..... 24/603

*Primary Examiner*—Richard E. Moore

*Attorney, Agent, or Firm*—Fraser and Bogucki

[57] ABSTRACT

A reusable, pneumatically releasable security tag for monitoring merchandise such as a garment, is disclosed. Encapsulated within the tag is a transponder element which reradiates a radio frequency signal to trigger an alarm when a tagged article is carried through a surveillance zone. The tag includes a housing concealing a one-way latch spring fastener for receiving and gripping the shank of a tack inserted through the garment and into the housing. The housing defines a chamber sealed by a generally horizontally oriented diaphragm adapted to be deflected by pressurized air admitted into the chamber through a small inlet. An actuator interposed between the diaphragm and the latch spring fastener is adapted to engage and deflect the fastener to a tack-releasing configuration upon the admission of pressurized air into the chamber.

A resilient pad may be inserted under the head of the tack. The pad is compressed upon insertion of the tack and protects the portion of the garment around the tack shank from tearing and assists the separation of the tack from the tag when the tack is released.

10 Claims, 6 Drawing Figures

PNEUMATICALLY RELEASABLE, TAMPER-RESISTANT SECURITY TAG

FIELD OF THE INVENTION

This invention relates generally to reusable, merchandise security tags adapted for attachment to the articles being monitored, and particlarly to a security tag having improved tamper-resistance and which is compact, inexpensive to manufacture and easily removable from the article by authorized personnel.

BACKGROUND OF THE INVENTION

Anti-theft systems are currently in use by retail and other business establishments for monitoring merchandise by electronic detectors which include radio frequency (RF) reradiators or transponders encapsulated within tags attached to the merchandise. Should an attempt be made to remove a tagged article from the premises, an alarm is triggered when the article is carried through a RF surveillance zone near the store exit.

Various techniques are known for releasably attaching the transponder tags to merchandise such as garments. Typically, the garment is pierced by a tack whose pointed shank is received and gripped by a releasable, "one-way" fastener or latch spring concealed within the tag housing. The housing is designed to prevent access to the latch spring save by means of a special releasing mechanism maintained at the checkout counter and operable by sales or other authorized personnel. Examples of prior art security tags and releasing mechanisms are disclosed in U.S. Pat. No. 3,942,829 (Humble et al).

Although successful in reducing theft, many prior art devices have disadvantages. Not only are they occasionally defeated by pilferers but the procedure for releasing them from the garments tends to be awkward in that one hand is required to hold the tag in position relative to the tag-releasing mechanism while the other is needed to actuate the mechanism. The separation of the tag and garment thus entails a time consuming operation which is undesirable at retail checkout stations where many items must be processed as quickly as possible.

U.S. Pat. No. 3,973,418, issued to the present inventor, discloses an improvement in which the transponder tag is adapted to be released pneumatically thereby providing an additional degree of tamper resistance. Within the tag housing a pair of thin, plastic diaphragms acts to release the latch spring fastener when pressurized air is admitted through a pair of inlet openings each of which leads to a chamber adjacent one of the diaphragms. The diaphragms are oriented vertically, that is, generally parallel with the tack shank. However, such orientation of the diaphragms, which must be large enough to deflect sufficiently, results in a relatively bulky structure. Further, after a period of use, the integrity of the seals about the peripheries of the diaphragms tends to deteriorate thereby adversely affecting the release function. Last, the proper application of sealing compound to the diaphragms and the need for careful assembly of the components to assure leak-free operation adds substantially to the manufacturing cost of this tag.

In light of the foregoing, it is an overall object of the present invention to provide an improved, reusable anti-theft transponder tag that is of rugged construction and provides a high degree of security and resistance to tampering.

It is another object of the invention to provide a reusable security tag whose design facilitates and expedites its release and removal from an article by authorized personnel at the point of sale.

Yet another object of the invention is to provide a compact, low cost, pneumatically releasable transponder tag whose sealing elements are not subject to leakage even after extensive periods of use.

SUMMARY OF THE INVENTION

In accordance with one specific, exemplary form of the invention, there is provided a reusable security tag having a cavity enclosing a detectable transponder element and adapted to be attached to an article such as a garment. The tag includes a housing having an aperture for receiving a tack whose pointed shank is adapted to pierce the article and to pass into the housing through the tack-receiving aperture. A one-way latch spring fastener enclosed within and concealed by the housing is adapted to receive and grip the tack shank. The fastener is of the type that is deflectable to a configuration in which the tack can be withdrawn. The housing further defines a chamber having an inlet for admitting air under pressure. Interposed between the chamber and the latch spring fastener are means operatively associated with the deflectable portions of the fastener and movable in a direction generally parallel with the tack shank, for effecting release of the tack. In operation, air under pressure admitted into the chamber through the inlet acts on the release-effecting means to deflect the fastener thereby releasing the tack and permitting its withdrawal from the housing.

A pneumatically actuated device provides a higher degree of security than is usually attainable with a device that is mechanically released. Moreover, release is facilitated because while one hand is used to push the tag into place against a valve element carried by a pneumatic release mechanism, the other can quickly separate the garment from the tag. Furthermore, in the present invention the orientation of the release-effecting means relative to the tack and to the chamber decreases the bulkiness of the device. More specifically, the release-effecting means includes a diaphragm that seals the chamber and lies generally in a plane that is substantially perpendicular to the tack shank. Deflections of the diaphragm as a result of pressurized air being admitted to the chamber are coupled to the latch spring fastener by means of an actuator interposed between the diaphragm and the fastener. The actuator has surfaces which are adapted to engage the displaceable or deflectable portions of the fastener. Further in this connection, the pointed end portion of the tack shank can penetrate the plane of the diaphragm and the tack shank length can be maximized by including within the confines of the chamber a central post having a well positioned to receive the end of the tack shank. The diaphragm is provided with a centrally located sleeve which fits in sealing engagement about the outer surface of the post.

The housing has a two-part construction comprising a top portion and a bottom portion which facilitates the assembly of the tag and provides a convenient way of sealing the periphery of the diaphragm. A horizontal surface or ledge circumscribes the upper extremity of the chamber and preferably includes a groove for receiving a lip or bead projecting from the outer edge of the diaphragm. The top portion of the housing has a corresponding flat, horizontal surface and when the top and bottom portions of the housing are assembled the peripheral portion of the diaphragm is squeezed between these confronting surfaces thus providing an effective edge seal.

An elastomeric pad or washer may be disposed under the head of the tack and may form a part thereof, the pad being adapted to be compressed between the head and the article upon insertion of the tack into the housing. When the latch spring fastener is released, the compressed pad aids in the separation of the tack from the tag and the article and additionally helps prevent tearing of the portion of the article about the tack shank.

BRIEF DESCRIPTION OF THE DRAWINGS

Further objects, advantages and features of the invention will become apparent from a reading of the detailed description below in conjunction with the accompanying drawings in which.

DETAILED DESCRIPTION OF THE PREFERRED EMBODIMENT

Figure 1:
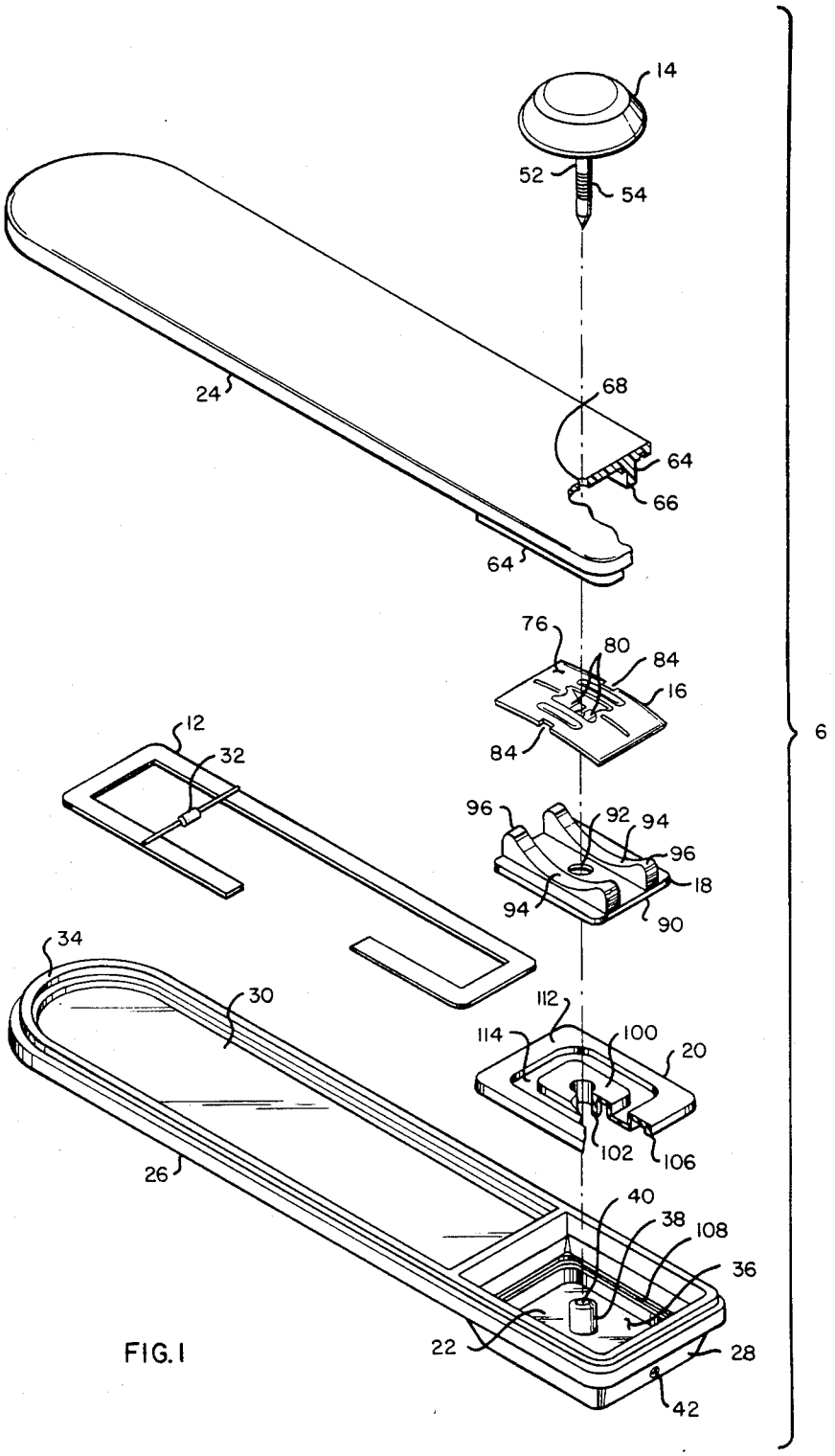
FIG. 1 is an exploded, perspective view of a pneumatically operated, tamper-resistant security tag in accordance with one embodiment of the invention.
Figure 2:
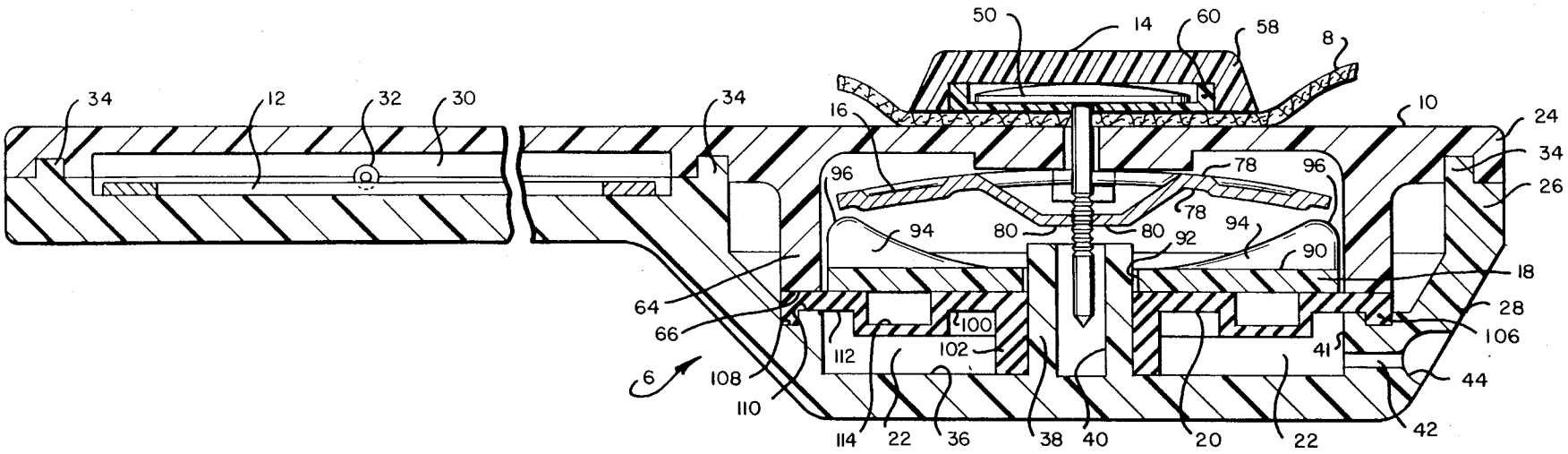
FIG. 2 is a side elevation in section, of the security tag of FIG. 1.
Figure 3:
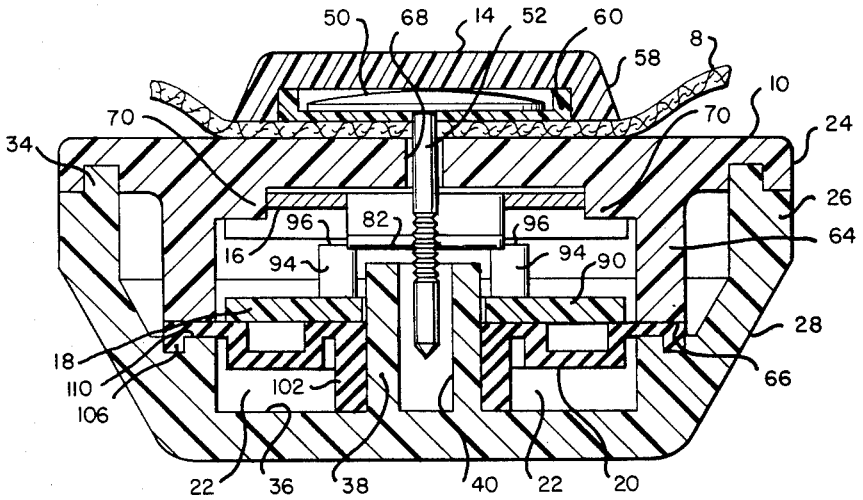
FIG. 3 is an end elevation view, in section, of the security tag of FIG. 1.

Referring now to the drawings and particularly to FIGS. 1–3, there is shown a reusable security tag 6 in accordance with a specific, preferred embodiment of the invention for monitoring an article such as a garment 8. The tag generally comprises a housing 10, an antenna 12 enclosed within the housing, a tack 14 adapted to be inserted through the article and into the housing 10, a one-way latch spring fastener 16 for gripping the pointed shank of the tack 14, a latch spring actuator 18 and a diaphragm 20 disposed between the actuator 18 and a chamber 22 defined by the housing 10. Briefly, upon admission of pressurized air into the chamber 22, the diaphragm 20 urges the actuator 18 into engagement with the latch spring 16 and deflects the spring 16 to a tack-releasing configuration.

Turning to the detailed structural features of the invention, the housing 10 is preferably made of high impact strength injection-molded plastic and consists of top and bottom mating portions 24 and 26, respectively. The housing has a flat, elongated configuration save for an enlarged section 28 depending from one end of the bottom housing 26. The enlarged section 28 contains the chamber 22 which has a generally rectangular configuration and is relatively shallow. The top and bottom parts 24 and 26 of the housing 10 further define a shallow, elongated cavity 30 for receiving the antenna 12 which comprises, as best shown in FIG. 1, an incomplete loop of flat, conductive material, such as brass shim stock, having a nonlinear electronic element, such as a diode 32, connecting opposite legs of the loop.

The mating housing portions 24 and 26 are joined by tongue-and-groove elements 34 disposed along the entire periphery of the interface of the housing portions and about the chamber 22. The housing parts 24 and 26 may be permanently joined by any of a variety of known bonding techniques including, for example, sonic welding.

The chamber 22 has a bottom wall 36 with a centrally located, upstanding, cylindrical post 38 having a bore or well 40. The chamber also has a side wall 41 including an air inlet aperture 42 communicating with the lowermost extremity of the chamber 22. The aperture 42 opens into a generally spherical pocket 44 formed in the exterior surface of the enlarged section 28, the pocket defining a seat for a correspondingly shaped valve element 46 form part of a pneumatic release mechanism (see FIGS. 4 and 6).

The tack 14 has a standard configuration, comprising a head 50 and a pointed shank 52 having serrations 54 along a portion of its length. The head 50 is enclosed within an enlarged casing consisting of two plastic portions 58 and 60 suitably bonded together.

Depending from the inner surface of the housing top 24 is a generally rectangular wall 64 having a lower, horizontal surface 66. A hole 68 in alignment with the well 40 in post 38, extends through the housing top and is adapted to receive the tack shank 52. The hole 68 is positioned centrally between a pair of parallel latch spring guides 70 projecting from the inner surface of the housing top.

The one-way fastener or latch spring 16 is fabricated of spring sheet metal, such as an appropriate beryllium-copper alloy, and has a rectangular shape. The latch spring includes an upper surface 76 and a lower surface 78 and in side elevation normally has a slightly curved configuration. Cuts formed in the latch spring in a generally H-shaped pattern define a pair of jaws 80 that are bent to project from the lower surface 78. The jaws 80 have transversely oriented, confronting edges 82 for gripping the serrated shank of tack 14. The latch spring has side notches 84 for receiving the guides 70. The tack can be easily inserted into the latch spring but can only be withdrawn, as is well known for fasteners of this general type, by deflecting the ends of the latch spring upwardly in relation to its central portion, thereby straightening the spring, so as to separate the confronting edges 82.

The actuator 18, disposed between the latch spring 16 and the diaphragm 20, includes a generally rectangular base 90 having a central opening 92 in alignment with the hole 68, and a pair of longitudinally oriented flanges 94 projecting upwardly from the base 90. The flanges 94 include raised extremities with surfaces 96 proximate the end portions of the latch spring 16 and adapted to engage those portions when the actuator 18 moves upwardly.

The diaphragm 20, of rubber or the like, is disposed generally horizontally, that is, perpendicular to the direction of the tack shank and has a central portion 100 with a depending tubular member or sleeve 102 which fits snugly about the post 38. A lip or bead 106 extends about the periphery of the diaphragm and is received by a groove 108 formed in a horizontal surface or ledge 110 circumscribing the upper extremity of the side wall 41 of chamber 22. The bead 106 is joined to the central portion 100 by the diaphragm by a horizontal web 112 and channel 114, the latter functioning to increase the pliability of the diaphragm.

Figure 4:
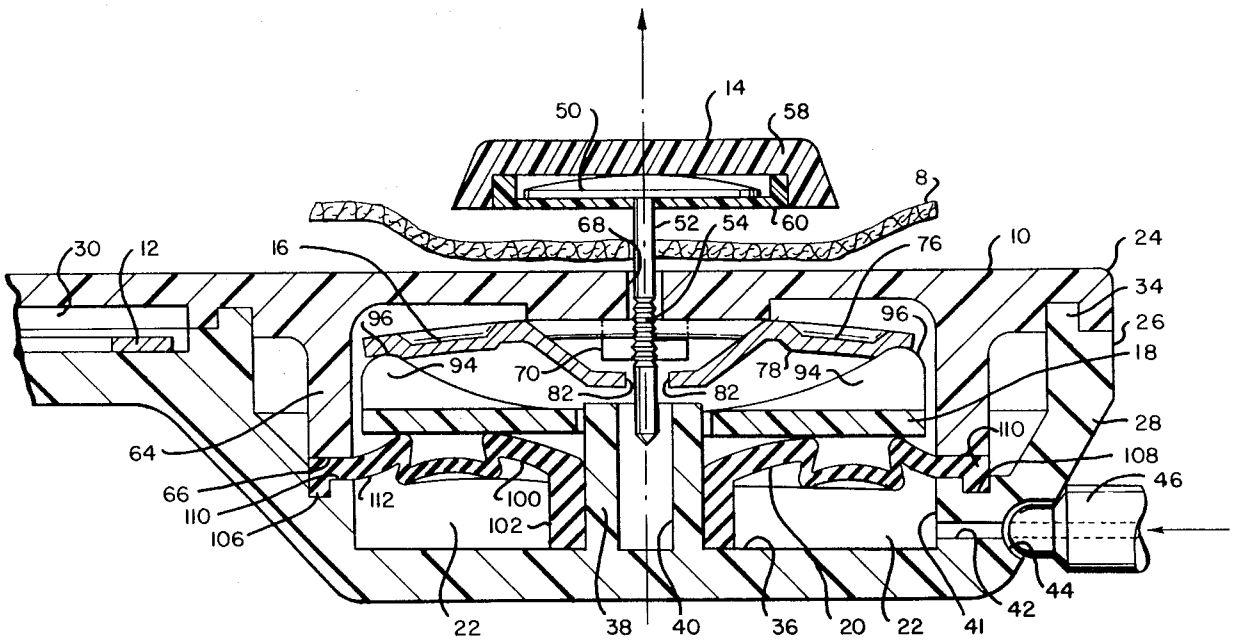
FIG. 4 is a side elevation view, in section, of a portion of the security tag of FIG. 1 during a tack-releasing operation.

As best shown in FIGS. 2–4, the outer periphery portion of the web 112 is sandwiched between the lower surface 66 on wall 64 and the surface 110, and, with the bead 106 thus securely retained in the groove 108, a tight peripheral seal is obtained. The sleeve 102, whose sealing function is enhanced when the chamber 22 is pressurized, prevents leakage of air past the post 38.

In using the transponder tag of the present invention, the tack 14 is pushed through the garment 8 and into the housing 10 via the opening 68 thereby securely clamping the garment between the head casing 56 and the housing top 24 (FIGS. 2, 3), In the final position of the tack, the pointed end portion of its shank 52 will typically enter the well 40 in the post 38. The latch spring jaws 80 securely retain the serrated tack shank and prevent the withdrawal of the tack.

Figure 6:
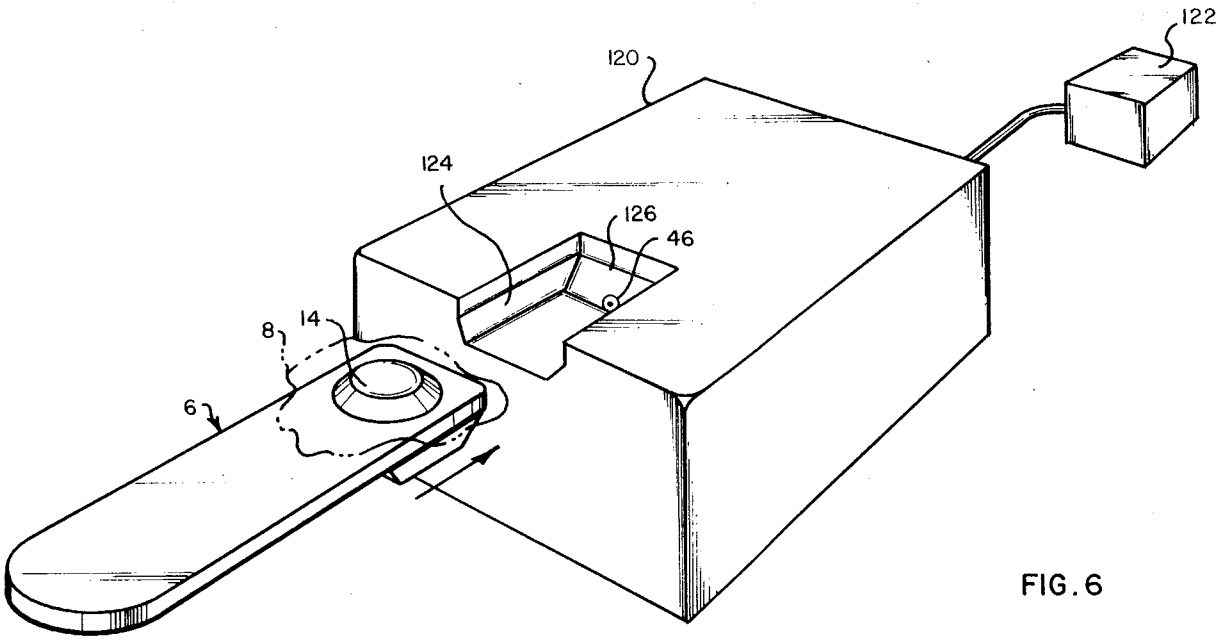
FIG. 6 shows in perspective and somewhat schematic form, a pneumatic release mechanism for releasing the tack from the tag.

With reference to FIGS. 4 and 6, removal of the tack is effected by a pneumatic releasing mechanism 120 supplied by an air source 122 maintained at elevated pressure, for example, 100 psi. The mechanism 120 includes a slot 124 for receiving the enlarged section 28 of the tag. The slot 124 terminates at an end wall 126 from which the valve element 46 projects. When the seat 44 is pressed against the valve element 46, air from the source 122 flows into the chamber 22 via the element 46 thereby deflecting the diaphragm 20 which in turn urges the actuator 18 into engagement with the end portions of the latch spring 16 tending to straighten the spring and separating the jaws 80 (FIG. 4). The tack may then be easily withdrawn from the tag housing.

Figure 5:
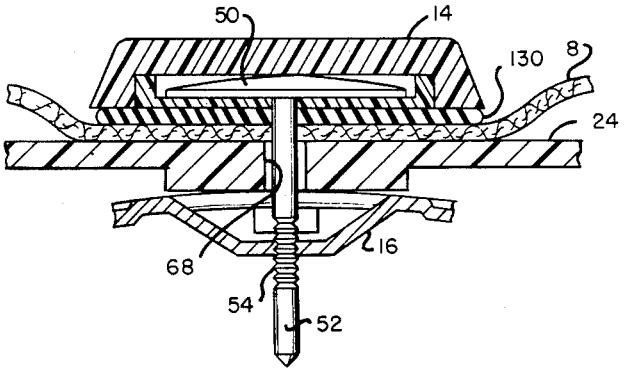
FIG. 5 is a side elevation view, in section, of a portion of the security tag of the invention in accordance with an alternative embodiment.

FIG. 5 shows an alternative embodiment of the invention in which removal of the tack 14 is further facilitated by including an elastomeric washer or pad 130 of rubber, foam, or the like, under the head of the tack. The pad 130 is compressed between the head and the garment when the tack is pressed into the housing. Upon release of the latch spring jaws 80 from the tack shank, the expanding washer urges the tack upwardly thereby assisting its quick removal. The frictional engagement of the pad 130 with the garment 8 over a relatively large area furthermore helps prevent the portion of the garment about the tack shank from being torn.

What is claimed is:

1. A reusable security tag adapted to carry a detectable transponder element and to be attached to an article such as a garment, including:

a housing having a tack-receiving opening and defining a chamber, the chamber having an air inlet;

a tack having a head and a pointed shank adapted to pass through the article and into the housing through the tack-receiving opening;

a one-way latch spring fastener enclosed within and concealed by the housing, the fastener being adapted to receive and grip the shank of the tack, portions of the fastener being displaceable to effect release of the tack; and means, interposed between the chamber and the latch spring fastener and operatively associated with the displaceable portions of the fastener, movable in a direction generally parallel with the tack shank for effecting release of the tack, air under pressure admitted into the chamber through the inlet acting on said release-effecting means to move said displaceable portions of the fastener to release the tack.

2. A reusable security tag, as set forth in claim 1, in which the means for effecting release of the tack includes:

a diaphragm sealing the chamber and lying generally in a plane that is substantially prependicular to the tack shank; and an actuator interposed between the diaphragm and the latch spring fastener, the actuator having surfaces adapted to engage the displaceable portions of the fastener.

3. A reusable security tag, as set forth in claim 1, which includes:

resilient means operatively associated with the tack and adapted to be compressed thereby upon insertion of the tack into the housing, whereby the separation of the tack from the tag and the article is assisted upon release of the tack.

4. A reusable security tag, as set forth in claim 3, in which:

the resilient means comprises an elastomeric washer under the head of the tack, the washer being adapted to be compressed between the head and the article upon insertion of the tack into the housing.

5. A reusable security tag adapted to carry a detectable transponder element and to be attached to an article such as a garment, including:

a housing having a tack-receiving opening;

a tack having a pointed shank adapted to pass through the article and into the housing through the tack-receiving opening;

a latch spring enclosed within and concealed by the housing, the latch spring including a pair of jaws with confronting edges adapted to receive and grip the tack shank, the latch spring permitting easy insertion of the tack shank into the latch spring but resisting withdrawal of the tack, the latch spring further having end portions deflectable in a direction generally parallel with the tack shank to separate the confronting edges of the jaws to release and permit withdrawal of the tack;

a chamber within the housing;

an inlet communicating with the chamber for admitting air under pressure into the chamber;

a diaphragm within the housing sealing the chamber, the diaphragm having portions deflectable in a direction generally parallel with the tack shank; and a movable actuator within the housing interposed between the diaphragm and the latch spring, the actuator having raised surfaces adapted to engage the deflectable end portions of the latch spring, pressurized air admitted through the inlet deflecting the diaphragm and displacing the actuator whereby the raised surfaces of the actuator engage and deflect the end portions of the latch spring to release and permit withdrawal of the tack.

6. A reusable security tag, as set forth in claim 5, in which:

the tack includes a head and an elastomeric pad under the head, the pad being adapted to be compressed between the head and the article upon insertion of the tack into the housing to assist in the separation of the tack from the tag and the article upon release of the tack and to help prevent damage to the portion of the article about the tack shank.

7. A reusable security tag, as set forth in claim 5, in which:

the chamber includes a bottom wall and a side wall, a post projecting from the bottom wall, the post having a well for receiving the tack shank; and the diaphragm having a central portion including a sleeve sealingly engaging the post and a peripheral bead sealingly associated with the side wall of the chamber.

8. A reusable security tag adapted to carry a detectable transponder element and to be attached to an article such as a garment, including:

a housing having a tack-receiving opening and including a side wall and a bottom wall, said walls defining a chamber, the side wall having an air inlet communicating with the chamber;

a post projecting upwardly from the bottom wall of the chamber, the post having a well;

a tack having a head and an elongated shank with a pointed end portion, the shank being adapted to pass through the article and into the housing, the well being positioned to receive the end portion of the shank;

a one-way latch spring fastener enclosed within and concealed by the housing, the fastener being adapted to receive and grip the shank of the tack, portions of the fastener being displaceable to effect release of the tack;

a diaphragm disposed generally perpendicular to the direction of the tack shank and sealing the chamber, the diaphragm including a sleeve sealingly engaging the post and having portions deflectable in a direction generally parallel with the tack shank; and a movable actuator within the housing interposed between the diaphragm and the latch spring, the actuator having surfaces adapted to engage the displaceable portions of the latch spring, pressurized air admitted through the air inlet deflecting the diaphragm and moving the actuator whereby said surfaces of the actuator engage and displace the displaceable portions of the latch spring to release and permit withdrawal of the tack.

9. A reusable security tag, as set forth in claim 8, which includes:

resilient means under the head of the tack adapted to be compressed between the head and the article upon insertion of the tack into the housing.

10. A reusable security tag adapted to carry a detectable transponder element and to be attached to an article such as a garment, including:

a housing comprising top and bottom portions, the bottom portion having a side wall and a bottom wall defining a chamber, the side wall having an air inlet and an upper extremity terminating at a first surface extending generally perpendicular to the side wall, the top portion of the housing including a tack-receiving opening and a second surface in confronting relationship with the first surface;

a post projecting upwardly from the bottom wall of the chamber, the post having a well;

a tack having an elongated shank with a pointed end portion, the shank being adapted to pass through the article and into the housing, the well being disposed to receive the end portion of the shank;

a one-way latch spring fastener enclosed within and sealed by the housing, the fastener being adapted to receive and grip the shank of the tack, portions of the fastener being displaceable to effect release of the tack;

a diaphragm sealing the chamber, the diaphragm having a central portion, a peripheral portion and deflectable portions between the central and peripheral portions, the central portion including a sleeve sealingly engaging the post, the peripheral portion being interposed in sealing relationship between the confronting first and second surfaces; and a movable actuator interposed between the diaphragm and the latch spring, the actuator having surfaces adapted to engage the displaceable portions of the latch spring, pressurized air admitted through the inlet deflecting the diaphragm and displacing the actuator whereby said surfaces of the actuator engage and displace the displaceable portions of the latch spring to release and permit withdrawal of the tack.

* * * * *